US005989058A

United States Patent [19]

Norgaard

[11] Patent Number: 5,989,058

[45] Date of Patent: Nov. 23, 1999

[54] ELECTRICAL WIRE/CABLE CONNECTOR

[76] Inventor: Thomas W. Norgaard, Edificio Secambú , Apt. 22A Piso 2, Calle Los Fernández, Urb. Sebucán, Caracas, Venezuela, 1071

[21] Appl. No.: 09/119,303

[22] Filed: Jul. 20, 1998

[51] Int. Cl.[6] ..... H01R 4/24

[52] U.S. Cl. ..... 439/429; 439/394

[58] Field of Search ..... 439/427, 428, 439/429, 805, 784, 394; 174/74 R, 84 R, 88 C, 92, 88 R

[56] References Cited

U.S. PATENT DOCUMENTS

| | | | |
|---|---|---|---|
| 457,865 | 8/1891 | Manson | 403/314 |
| 1,973,322 | 9/1934 | Staples | 439/784 |
| 3,071,751 | 1/1963 | Horndasch | 439/429 |
| 3,156,762 | 11/1964 | Matthysse | 173/263 |
| 4,050,773 | 9/1977 | Nowell | 439/428 |
| 4,091,233 | 5/1978 | Berman | 174/81 |
| 4,454,376 | 6/1984 | Holder et al. | 174/88 R |
| 5,618,200 | 4/1997 | Norgaard | 439/427 |

*Primary Examiner*—Neil Abrams
*Assistant Examiner*—Javaid Nasri
*Attorney, Agent, or Firm*—Fellers, Snider, Blakenship, Bailey & Tippens, P.C.

[57] ABSTRACT

The inventive connector includes a tubular dielectric external element within which is disposed an internal conductive element. Two ends of wire or coaxial cable are pushed into the device. The internal conductive element has skiving edges at each end which separate the conductors from the insulating layers. The conductors contact the internal conductive element to form an electrical connection while the skived insulation layers are used to further insulate the device and to apply a holding pressure.

20 Claims, 3 Drawing Sheets

ELECTRICAL WIRE/CABLE CONNECTOR

BACKGROUND OF THE INVENTION

1. Field of the Invention:

This invention relates generally to devices for connecting wires, and more specifically, to a device that permits the ends of wires conducting electricity or other signals to be connected efficiently, safely and easily without the requirement of conventional preparation.

2. Background

The joining of electrical and signal conductors has generally involved twisting the two conductors together and soldering or otherwise physically joining the conductors. Wire connectors comprising a plastic outer shell and a single, unidirectional threaded insert are sometimes used to achieve a physical connection of two wire ends. With this type of connection, the conductors are held with their exposed ends in the same direction whereupon the ends are twisted together and the connector is applied to the intertwined conductors. Twisting the connector in a clockwise direction draws the ends of the conductors into tight contact with each other in the conductive thread of the connector, forming a satisfactory electrical connection.

One problem with physical connections of the type described is that the ends of wire must be prepared for the connection by cutting and trimming away insulation layers and then twisting or otherwise joining the wires together. The connections which are formed can be bulky and in many instances very difficult to achieve. Also, the change in direction required of the conductor is not convenient for the transmission of the signal. Connections of the type described also generate heat and are subject to rapid deterioration which increases the risk of a short circuit.

The applicant, in U.S. Pat. No. 5,618,200, which patent is incorporated herein by reference, addressed the problems of the prior art by providing a connector for wires that successfully eliminated the need for cutting, trimming, twisting or using insulating tape to achieve electrical connections between two ends of wire. The subject connector consists of two elements, a tubular external element and an internal element or internal metal contact. The external element has two oppositely disposed orifices each being adapted to receive an end of an insulated wire. A separate internal contact having oppositely disposed contact surfaces is positioned within the external element. The inner walls of the ends of the external element are internally and oppositely threaded such that by rotating the external element each wire end is drawn toward or expelled from the connector depending on the direction of rotation. Electrical communication between the wires is established when the conductors within the wire ends make contact with the internal element.

One limitation of applicant's prior device is that it does not separate the conductors from the insulation in the wires to be joined. Better connections can be achieved in certain circumstances when the conductive elements of the wire are isolated. Moreover, certain types of wires, such as coaxial wire or cable, have more than one conductor separated by an intermediate insulation layer. Wires or cable with such multiple conductors require electrical connections to be established between each conductor. Connections of coaxial wires are typically done by cutting the insulation, exposing the two conductors, and introducing both conductors into a metal coaxial connector. This is not convenient for the transmission of signals because of the drain of current through the metal connector and the exposure of the two conductors. The present invention is directed to novel improvements to the prior device which expand its capabilities to achieve better connections and to be used in connection with a wider variety of insulated wire or cable types.

SUMMARY OF THE INVENTION

The inventive connector includes a tubular dielectric external element within which is disposed an internal conductive element. Two ends of wire or coaxial cable are pushed into the device. The internal conductive element has skiving edges at each end which separate the conductors from the insulating layers. The conductors contact the internal conductive element to form an electrical connection while the skived insulation layers are used to further insulate the device and to apply a holding pressure for the connector.

The present invention has two preferred embodiments. The first embodiment is directed to electrically connecting the ends of two insulated wires having a single solid or filamentous conductor. A dielectric external element houses an electrically conductive internal element. The external element is tubular, having an inner wall that forms a longitudinal bore. At each end of the external element there is a wire entry orifice for receiving an end of insulated wire. The internal element is similar in length to the external element and has a central section of a diameter sufficient to friction fit against the inner wall of the hollow external element such that the internal element is securely seated within the longitudinal bore. The internal element has first and second reduced-diameter tubular ends that terminate with an outer sharp skiving edge. The function of the internal element is to form an electrical bridge between the two conductors. Of course to do this the conductors must securely contact the conductive internal element. This contact is made at the inner surfaces of the tubular ends of the internal element. When two ends of insulated wire are inserted into the connector, the outer skiving edges of the tubular ends separate the conductors from the insulation layers. The conductors enter the interior of the tubular ends, contacting the interior surface, while the insulating layers ride over the external surface of the tubular ends into an insulation receiving space between the tubular ends and the inner wall of the external element.

In a preferred aspect of this embodiment, the external and internal surfaces of the tubular ends of the internal element are threaded, each end in an opposite direction. Thus, when the external element is rotated the conductors and insulating layers are drawn into or expelled from the connector evenly and easily. In additional to facilitating this, the external threads function to increase the diameter of the insulation layer thereby applying pressure in all directions against the inner wall of the external element. Another function of the internal threads is to apply additional pressure to the conductor.

The second preferred embodiment is especially useful for the connection of coaxial wires and cables that have a solid inner or central conductor surrounded by a tubular outer conductor separated by an intermediate insulation layer. The outer conductor is generally covered with a outer rubber or elastomeric insulating covering. Like the first embodiment, this connector has a tubular, dielectric external element. Unlike the first embodiment, however, the device includes two internal elements of a length roughly equivalent to the external element. The first internal element is similar to the one described above. It is electrically conductive and has a central section of a diameter sufficient to bear against the inner wall of the external element so that the internal element is held concentrically therein. The first internal element also has first and second reduced-diameter tubular ends, each with an outer skiving edge. The second internal element is also electrically conductive and is held concentrically within the first by a central circumferential dielectric support sleeve. The second internal element has first and second tubular ends, each also having an outer skiving edge. In this embodiment there is created within the connector (1) opposed outer conductor receiving spaces between the external surface of the tubular ends of the first internal element and the inner wall of the external element, (2) opposed central conductor entry orifices circumscribed by the outer skiving edge of the tubular ends of the second internal element, and (3) opposed insulation receiving spaces between the outer surface of the tubular ends of the second internal element and the inner surface of the first internal element. When two ends of insulated coaxial wire are inserted into the connector, the outer skiving edges of the tubular ends of the first internal element separate the outer conductors from the intermediate dielectric. The outer conductors and the outer insulating covering enter the outer conductor receiving space where the outer conductors contact the external surface of the tubular ends of the first internal element. Meanwhile, the outer skiving edges of the second internal element separate the central conductors from the first insulating layers. The central conductors enter the central conductor entry orifice into the interior of the tubular ends of the second internal element. There they contact the interior surface of the tubular ends which establishes an electrical bridge between the central conductors. The insulating layers enter the insulation receiving spaces between the two internal elements.

In a preferred aspect of this embodiment, the external surfaces of the first and second tubular ends of the first internal element are oppositely threaded and, in a similar fashion, the internal surface of the first and second tubular ends of the second internal element are oppositely threaded, providing the above-described advantages.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENTS

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
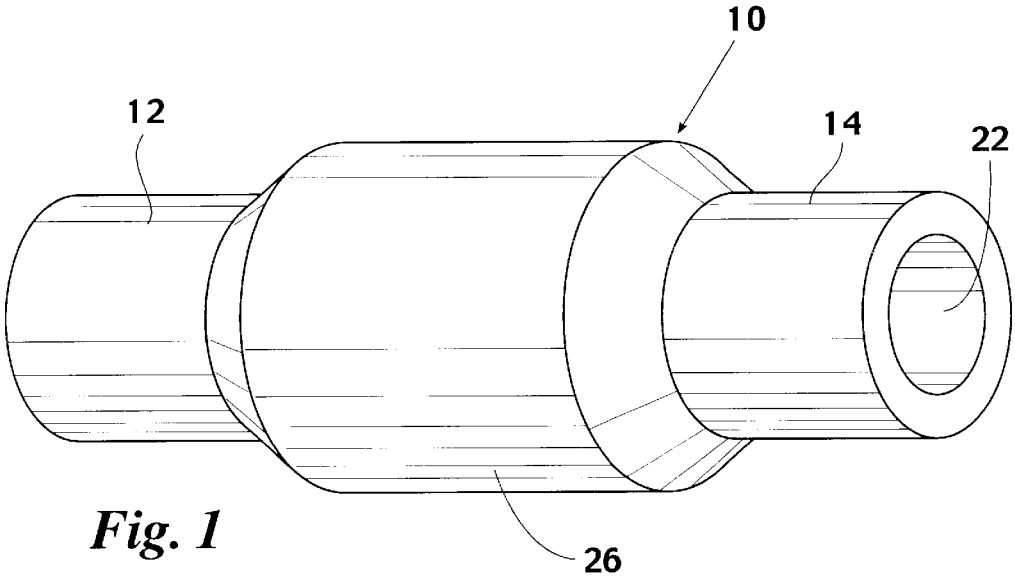
FIG. 1 is a perspective view of the preferred external element.
Figure 2:
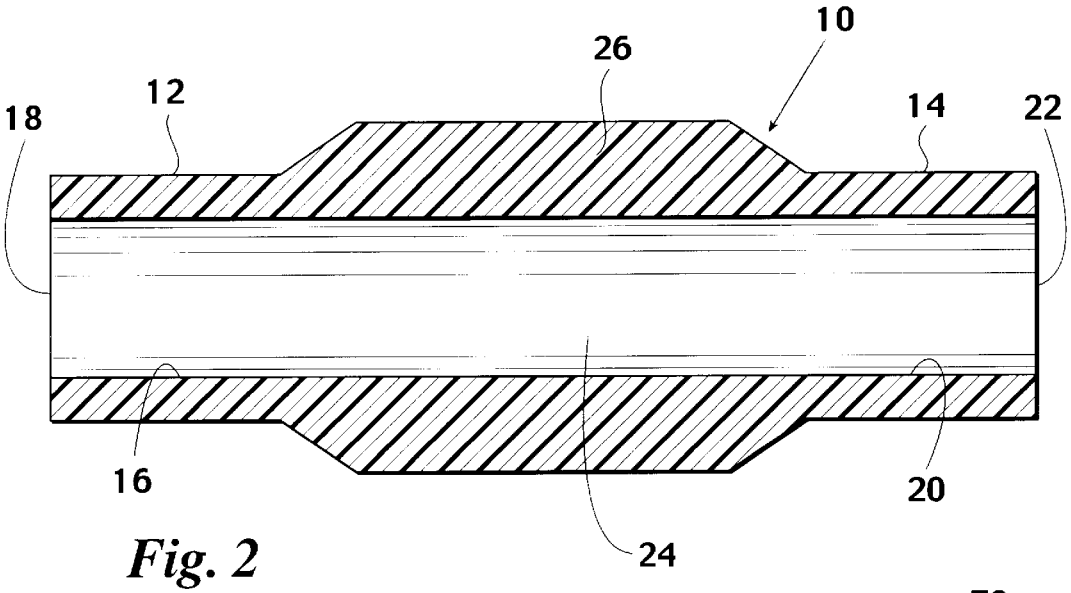
FIG. 2 is a cross-sectional view of the external element.

Both of the preferred embodiments described herein utilize the external element 10 illustrated in FIGS. 1 and 2. External element 10 has a first tubular end 12 and a second tubular end 14. The inner wall 16 of the first tubular end 12 circumscribes a wire entry orifice 18. In like manner, the inner wall 20 of the second tubular end 14 circumscribes an opposed wire entry orifice 22. Each wire entry orifice 18, 22 is sized to receive a certain diameter insulated wire or cable. In the most preferred embodiment the external element 10 is cylindrical and hollow, having a smooth longitudinal bore 24 running completely therethrough of a diameter equivalent to that of the wire entry orifices 18, 22. Also, in the most preferred embodiment the external element 10 has a central grip section 26 having an increased outer diameter to aid in the holding and turning of the device. The grip section 26 may be knurled if desired or shaped, hexagonally or otherwise, to accept a turning tool.

The external element 10 is dielectric and may be made of any suitable insulating material such as, for example, a high resistance plastic. The external element 10 may be a molded unitary piece or, alternatively, it may be manufactured as a two-piece unit as shown in U.S. Pat. No. 5,618,200. If made of the two-piece unit, the two-halves may be closed by a snap fit connection, by ultrasonic welding or in other manners known in the art. The important features of the external element 10 are that it be non-conductive and capable of performing its function as a housing for the additional elements as described hereinbelow.

First Preferred Embodiment

Figure 3:
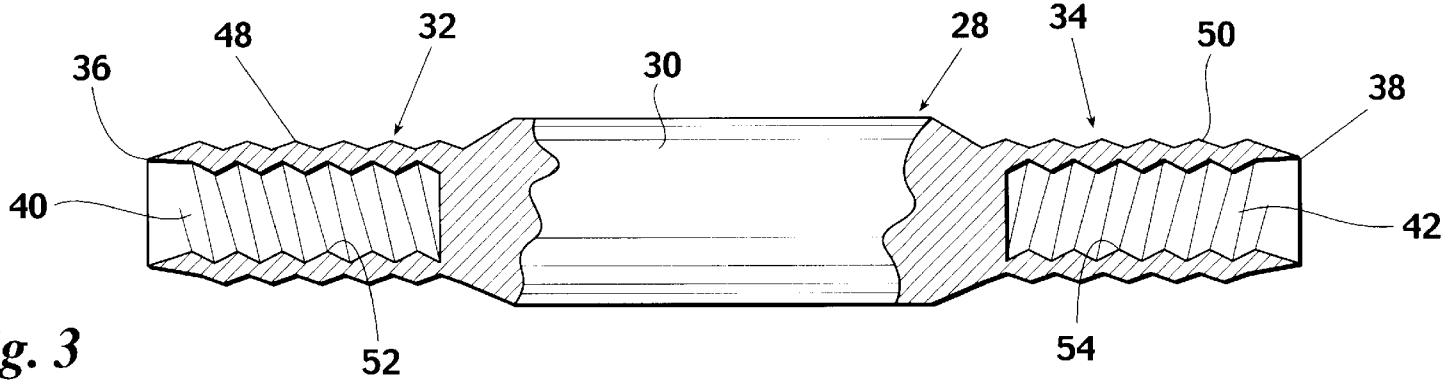
FIG. 3 is a partial cross-sectional view of the internal element of the first preferred embodiment.

The first preferred embodiment of the present invention consists of the aforementioned external element 10 and the complimentary internal conductive element 28 shown in FIG. 3. Internal conductive element 28 has a central bearing section 30 of a diameter sufficient to friction fit against the central inner surface of the external element 10 such that the internal element 28 is securely seated within the longitudinal bore 24 of the external element 10. The internal element 28 has first and second reduced-diameter, tubular ends 32, 34, each having an outer skiving edge 36, 38. Each outer skiving edge 36, 38 circumscribes a central conductor entry orifice 40, 42 that is coaxial, i.e. concentric, with the wire entry orifices 18, 22 of the external element 10. The central conductor entry orifices 40, 42 are sized to accept a single solid or filamentous conductor.

Figure 7:
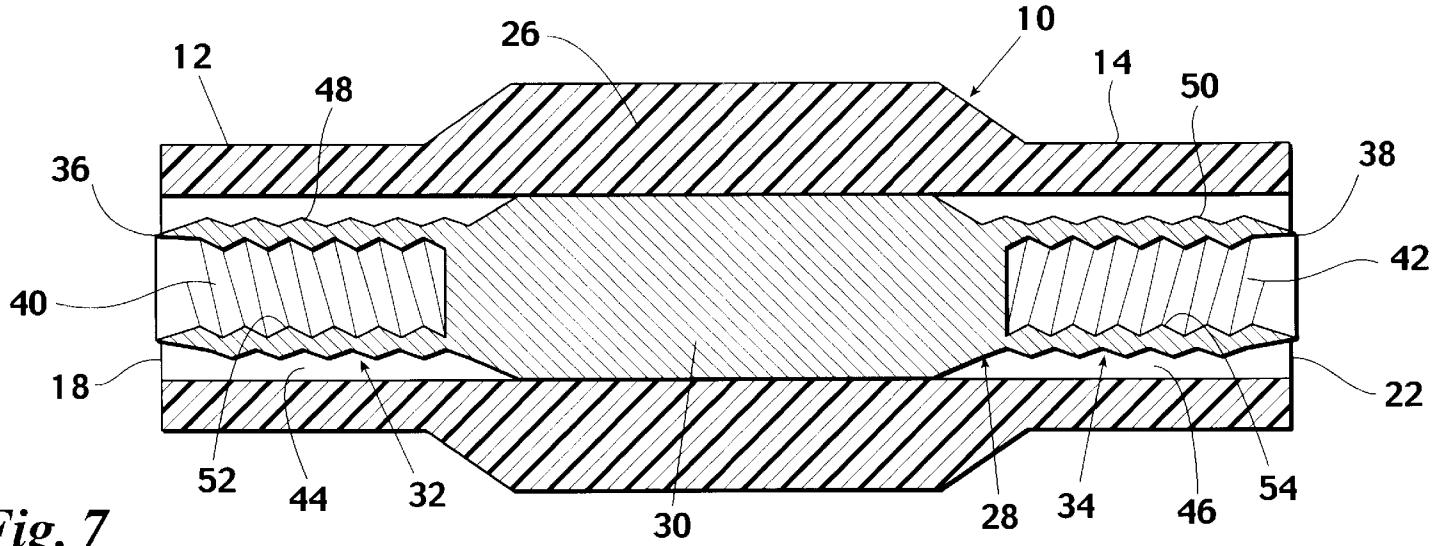
FIG. 7 is a cross-sectional view showing the first preferred embodiment.

As shown in FIG. 7, the internal element 28 is centrally positioned within the external element 10 where the central bearing section 30 of the internal element 28 tightly contacts the inner surface of the external element 10. The friction fit between the external element 10 and internal element 28 prevents longitudinal slipping of the components. Alternatively, components could be keyed, adhesively bonded or otherwise stabilized in the appropriate position. Owing to the reduced-diameter of the first and second tubular ends 32, 34 of the internal element 28, an insulation receiving space 44, 46 is created between the external surface of the tubular ends 32, 34 in the inner walls 16, 20 of the tubular ends 12, 14 of the external element 10.

The internal element 28 is preferably made of an electrically conductive metal or metal alloy. Particularly preferred is a beryllium/copper alloy.

In use, two ends of insulated wire are pushed into the ends of the external element 10 through the wire entry orifices 18, 22. The insulated wire need not be prepared in any special manner. As the wire is inserted the outer skiving edges 36, 38 of the tubular ends 32, 34 of the internal element 28 separate the conductors from the insulation layers. The conductors enter the central conductor entry orifices 40, 42 into the interior of the tubular ends 32, 34. There, the conductors contact the interior surface of the tubular ends 32, 34 which results in an electrical connection being established between the conductors. During this operation the skived insulating layers are forced into the respective insulation receiving spaces 44, 46.

As shown in FIGS. 3 and 7, in the most preferred embodiment the external and internal surfaces of the first tubular end 12 are threaded with threads of a first direction while the external and internal surfaces of the second tubular end 34 are threaded with threads of an opposite direction. When the external element 10 is rotated the conductors and insulating layers are then drawn into or expelled from the device in an easy, even manner. The external threads 48, 50 engage the insulation layer, expanding and pressing it against the inner surface of the external element 10. The internal threads 52, 54 closely engage the conductors, helping to establish a tight, secure electrical connection.

It is additionally preferred that the outer skiving edges 36, 38 of the internal element 28 be conically shaped as shown in the drawings so as to perform the separation more effectively and to expand the diameter of the insulating layers as the layers are separated from the conductors and as they enter the insulation receiving spaces 44, 46.

Second Preferred Embodiment

The second preferred embodiment differs from the first in that two internal conductive elements are utilized. The preferred internal elements are illustrated in FIGS. 4 and 5.

Figure 4:
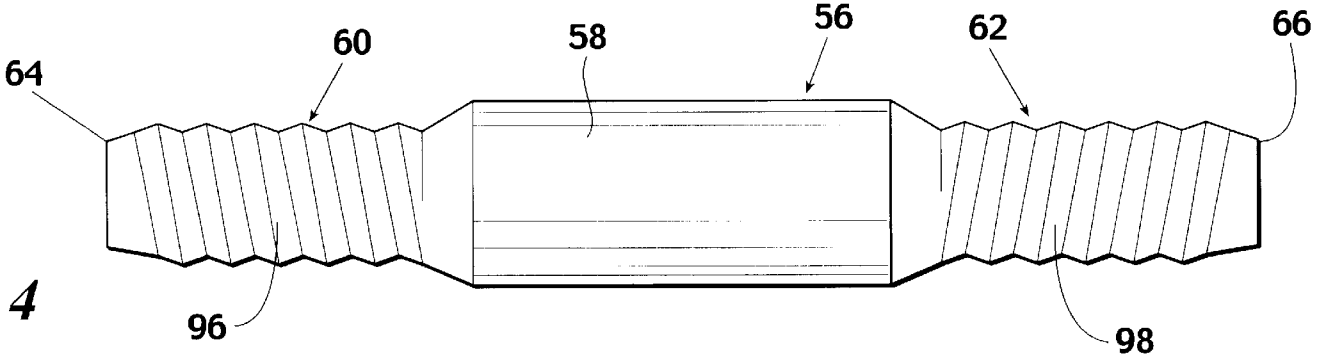
FIG. 4 is an elevational view of the first internal element of the second preferred embodiment.

FIG. 4 shows an elevational view of the first internal element 56 of the second preferred embodiment. This element 56 may also be thought of as being the "outer" of the two internal elements. Similar to the internal element of the first preferred embodiment, element 56 has a central bearing section 58 of a diameter sufficient to friction fit against the interior of the external element 10. The first internal element 56, likewise, has first and second reduced-diameter tubular ends 60, 62, each of the tubular ends 60, 62 having an outer skiving edge 64, 66.

Figure 6A:
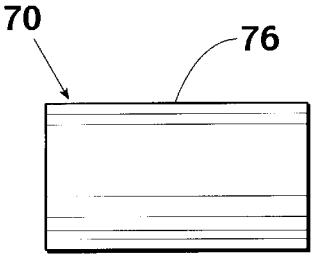
FIG. 6A is an elevational view of the preferred support sleeve used in the second preferred embodiment.
Figure 6C:
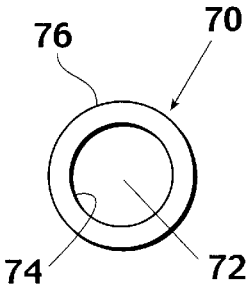
FIG. 6C is an end view of the same support sleeve.
Figure 6B:
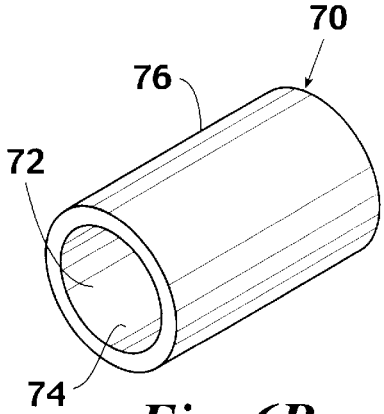
FIG. 6B is a perspective view of the same support sleeve.
Figure 5:
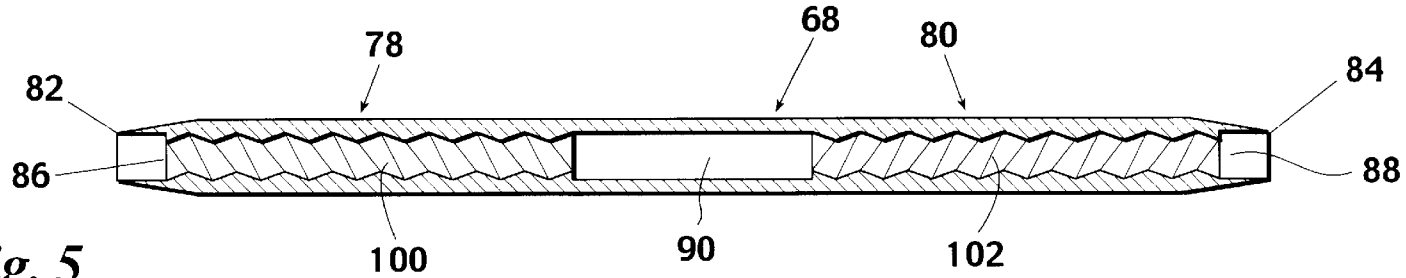
FIG. 5 is a cross-sectional view of the second internal element of the second preferred embodiment.

FIG. 5 shows the second internal element 68, which can also be considered to be the "inner" internal element, as it is held in a spaced, concentric position within the first internal element 56. This is accomplished through the use of the circumferential dielectric support and insulation sleeve 70 illustrated in FIGS. 6A–6C. The support sleeve 70 is composed of an insulating material such as a high resistance plastic. It is a cylindrically shaped tubular element having a bore 72, an inner bearing surface 74, and an outer bearing surface 76. The support sleeve 70 slips over the second internal element 68 where it is centrally positioned, either by friction fit or by adhesive means. The support sleeve 70 functions to maintain the position of the second internal element 68 within the first internal element 56 while also isolating and electrically insulating both internal elements.

Still with respect to FIG. 5, the second internal element 68 has first and second tubular ends 78, 80, each with an outer skiving edge 82, 84 that circumscribes a central conductor entry orifice 86, 88. A central section 90 of the second internal element 68 provides an outer bearing surface for contact with the inner bearing surface 74 of the support sleeve 70.

Figure 8:
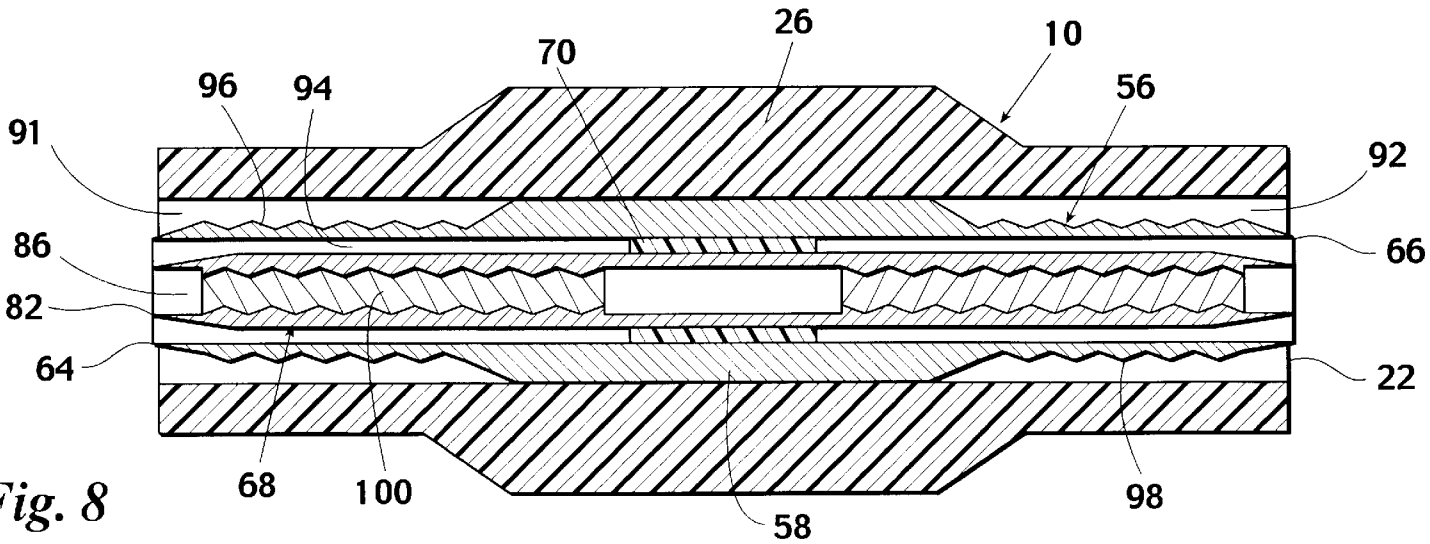
FIG. 8 is a cross-sectional view showing the second preferred embodiment.

Turning now to FIG. 8, there is shown the second preferred embodiment in partial cross-section. This embodiment is particularly useful in the joining of two ends of coaxial type cable or wire. As used herein the term "coaxial cable" or "coaxial wire" means a type of transmission line consisting of an outer conductor (generally a grounding conductor) surrounding an inner conductor (generally a signal conductor) separated by an intermediate insulation layer. The outer conductor is also usually surrounded by an outermost insulating covering, such as rubber or an elastomeric material. This type of cable is used extensively to feed HF and VHF antennae and for multiplex signals in long distance telecommunications. Accordingly, the second embodiment of the present invention permits the connection of wires or cables which conduct video, television or sound signals without cutting, trimming or twisting the wires, the resulting connection being safe and efficient.

In the second preferred embodiment a number of receiving spaces are created to allow for the electrical coupling of the two conductors and to provide further insulation between the first and second internal elements. As shown in FIG. 8, an outer conductor receiving space 90, 92 is created between the external surface of each tubular end 60, 62 of the first internal element 56 and the inner walls 16, 20 of the tubular ends 12, 14 of the external element 10. The area between the outer surface of the tubular ends 78, 80 of the second internal element 68 and the inner surfaces of the tubular ends 60, 62 of the first internal element 56 define an insulation receiving space 94. Thus, when two ends of insulated, coaxial wire are inserted into the inventive connector, the outer skiving edges 64, 66 of the first internal element 56 separate the outer conductors from the intermediate insulating layer. The outer conductors and the outermost insulating covering enter the outer conductor receiving space 90, 92 where the outer conductors contact the external surface of the tubular ends 60, 62 of the first internal element 56, thus establishing electrical communication. In a similar manner the outer skiving edges 82, 84 of the second internal element 68 separate the central conductors from the intermediate insulating layers. The central conductors enter the central conductor entry orifice 86, 88 into the interior of the tubular ends 78, 80 of the second internal element 68 where they contact the interior surface of the tubular ends 78, 80, thereby establishing an electrical connection. The insulating layers enter their respective insulation receiving space, providing further insulation between the first and second internal elements.

Oppositely directed external threads 96, 98 are preferably utilized on the first internal element 56 while oppositely directed internal threads 100, 102 are disposed at each end of the second internal element 68. Thus, each end of coaxial wire is evenly and easily drawn into or expelled from the inventive connector by rotating the connector. It is also preferred that each outer skiving edge be conically shaped. These features provide the same advantages in this embodiment as described above in connection with the first preferred embodiment. The oppositely threaded external threads 96, 98 of the first internal element 58 will draw or expel the outer conductor from the connector, depending on the direction of rotation, while the internal threads 100, 102 of the second internal element 68 act on the central conductors. The conically shaped outer skiving edges 82, 84 of the second internal element 68 expand the diameter of the intermediate insulation layer and press it against the inner surface of the tubular first internal element 58. Rather than trimming away the intermediate insulation layer, the present invention uses it to increase the insulation between the two conductive internal elements. The conically shaped outer skiving edges 64, 66 of the first internal element 58 expand the diameter of the outer conductors and outermost insulating covering, thus establishing a better electrical connection between the outer conductors and the first internal element 58 and pressing the insulating covering against the inner walls of the external element 10. Similar to the first embodiment, in the second embodiment the external element 10 is also made of a high resistance plastic or other non-conductive material. Both the first and second internal elements 56, 68 are constructed of any electrically conductive metal or metal alloy, such as the preferred beryllium/copper alloy.

Thus, it can be seen that the inventive connector can quickly and easily join the two ends of various wires or cables without the need for conventional end preparation and without utilizing conventional, and problematic, splicing techniques.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A connector for electrically connecting the ends of two insulated wires (each having at least one conductor and an insulation layer), comprising a tubular dielectric external element within which is disposed an internal conductive element, said internal conductive element having skiving edges at each end thereof, whereby when two ends of wire or coaxial cable are pushed into the connector said skiving edges separate the conductors from the insulation layers, the conductors contacting said internal conductive element to form an electrical connection while the skived insulation layers are used to further insulate the connector.

2. The conductor according to claim 1, wherein said internal conductive element includes tubular ends, each having an external surface and a threaded interior surface to engage and draw the conductor into the internal conductive element.

3. The connector according to claim 2 wherein said external surface is threaded to facilitate the skived insulation layers to ride over said external surface.

4. A connector for electrically connecting the ends of two insulated wires (each having a conductor and an insulation layer), comprising:

a tubular, dielectric external element having an inner wall forming a longitudinal bore and having a wire entry orifice at each end thereof, each said wire entry orifice for receiving an end of an insulated wire;

an electrically conductive internal element concentrically seated with said longitudinal bore of said external element, said internal element having first and second reduced-diameter tubular ends, each of said tubular ends having an interior surface, an external surface and an outer skiving edge that circumscribes a central conductor entry orifice and defining an insulation receiving space between the external surface of said tubular end and said inner wall;

whereby when two ends of insulated wire are inserted into said wire entry orifices said outer skiving edges of said tubular ends separate the conductors from the insulation layers, the conductors entering said central conductor entry orifice into the interior of said tubular ends in contacting engagement with the interior surface of said tubular ends; thereby establishing an electrical connection between the conductors, and the insulation layers ride over the external surface of said tubular ends entering said insulation receiving spaces to apply pressure against the inner wall of said dielectric external element.

5. The connector of claim 4, wherein said outer skiving edges are conically shaped so as to expand the diameter of the insulating layers as the layers are separated from the conductors.

6. The connector according to claim 4, wherein said external element has a central grip section having an increased outer diameter to aid in the holding and turning of said connector.

7. The connector according to claim 4, wherein said external element is made of a high resistance plastic.

8. The connector according to claim 4, wherein said internal element is made of an electrically conductive metal or metal alloy.

9. The connector according to claim 8, wherein said internal element is made of a beryllium/copper alloy.

10. The connector according to claim 4, wherein said interior surface of said tubular ends securely engage the conductor within said central conductor entry orifice.

11. The connector according to claim 10, wherein said interior surfaces of said tubular ends are threaded to engage and draw the conductor into the central conductor entry orifice.

12. The connector according to claim 11, wherein said external surfaces of said tubular ends are threaded to guide the respective insulation layers into said insulation receiving spaces.

13. The conductor according to claim 4, wherein said external and interior surfaces of said first tubular end are threaded with threads of a first direction and said external and interior surfaces of said second tubular end are threaded with threads of an opposite direction such that when said connector is rotated the conductors and insulating layers are drawn into or expelled from said connector, depending upon the direction of rotation.

14. A connector for electrically connecting the ends of two insulated coaxial wires (each having a central conductor, an intermediate insulation layer surrounding the central conductor, an outer conductor and an outer insulating covering), comprising:

a tubular, dielectric external element having an inner wall forming a longitudinal bore and having a wire entry orifice at each end thereof, each said wire entry orifice for receiving an end of an insulated coaxial wire;

an electrically conductive tubular first internal element concentrically seated within said longitudinal bore of said external element, said first internal element having first and second reduced-diameter tubular ends, each of said tubular ends having an outer skiving edge and defining an outer conductor receiving space between the external surface of said tubular end and said inner wall of said external element;

an electrically conductive second internal element concentrically seated within said first internal element by a central circumferential dielectric support sleeve, said second internal element having first and second tubular ends, each said tubular end having an outer skiving edge that circumscribes a central conductor entry orifice and defining an insulation receiving space between the outer surface of said tubular ends and the inner surface of said first internal element;

whereby when two ends of insulated coaxial wire are inserted into said wire entry orifices said outer skiving edges of said tubular ends of said first internal element separate the outer conductors from the intermediate insulation layers, the outer conductors and the outer insulating covering entering said outer conductor receiving space where the outer conductors contact the external surface of said tubular ends of said first internal element thereby establishing an electrical connection between the outer conductors, and said outer skiving edges of said second internal element separate the central conductors from the intermediate insulation layers, the central conductors entering said central conductor entry orifice into the interior of said tubular ends of said second internal element in contacting engagement with the interior surface of said tubular ends thereby establishing an electrical connection between the central conductors, and said insulation layers entering the insulation receiving spaces.

15. The conductor according to claim 14, wherein said external surfaces of said first and second tubular ends of said first internal element are oppositely threaded and said internal surface of said first and second tubular ends of said second internal element are similarly oppositely threaded.

16. The connector of claim 14, wherein said outer skiving edges are conically shaped.

17. The connector according to claim 14, wherein said external element has a central grip section having an increased outer diameter to aid in the holding and turning of said connector.

18. The connector according to claim 14, wherein said external element is made of a high resistance plastic.

19. The connector according to claim 14, wherein said first and second internal elements are made of an electrically conductive metal or metal alloy.

20. The connector according to claim 19, wherein said first and second internal elements are made of a beryllium/copper alloy.

* * * * *